US006104143A

United States Patent [19]

Bonavia

[11] Patent Number: 6,104,143

[45] Date of Patent: Aug. 15, 2000

[54] EXCITER CIRCUIT WITH SOLID SWITCH DEVICE SEPARATED FROM DISCHARGE PATH

[75] Inventor: Howard V. Bonavia, Groton, N.Y.

[73] Assignee: Peabody Engineering Corporation, Shelton, Conn.

[21] Appl. No.: 09/409,828

[22] Filed: Oct. 1, 1999

[51] Int. Cl.[7] ..... H05B 37/02

[52] U.S. Cl. ..... 315/209 CD; 315/209 R; 315/209 SC; 315/225

[58] Field of Search ..... 315/209 CD, 209 T, 315/209 SC, 209 R, 307, DIG. 7, 209 M, 225, 246

[56] References Cited

U.S. PATENT DOCUMENTS

| | | | |
|---|---|---|---|
| 4,719,896 | 1/1988 | Nakayama et al. | 123/599 |
| 4,733,646 | 3/1988 | Iwasaki | 123/597 |
| 4,809,661 | 3/1989 | Kinoshita et al. | 123/418 |
| 5,399,942 | 3/1995 | Frus | 315/209 R |
| 5,530,617 | 6/1996 | Bonavia et al. | 361/253 |
| 5,561,350 | 10/1996 | Frus et al. | 315/209 R |
| 5,754,011 | 5/1998 | Frus et al. | 315/209 SC |
| 5,852,381 | 12/1998 | Wilmot et al. | 327/440 |
| 5,862,033 | 1/1999 | Geislinger et al. | 361/257 |
| 5,910,712 | 6/1999 | Toyama | 315/307 |

*Primary Examiner*—Don Wong
*Assistant Examiner*—Tuyet T. Vo
*Attorney, Agent, or Firm*—Watts, Hoffman, Fisher & Heinke, Co., L.P.A.

[57] ABSTRACT

An exciter circuit for an ignition system including an igniter plug. The exciter circuit includes an energy storage device comprising a pair of capacitors and a charging circuit for charging the capacitors of energy storage device to a predetermined voltage. The exciter circuit further includes a discharge circuit electrically coupled to the energy storage device and the igniter plug providing a conductive path between the energy storage device and the igniter plug. The exciter circuit periodically energizes the igniter plug by applying an output signal of the discharge circuit to the igniter plug, the output signal having a voltage magnitude sufficient to initiate a spark across electrodes of the igniter plug. The discharge circuit includes a polarity reversal circuit coupled to the energy storage device for periodically reversing a polarity of the charge on one of the capacitors and discharging the energy storage device to generate the output signal wherein the voltage magnitude of the output signal is greater in magnitude than the predetermined voltage of capacitors. A solid state switch, preferably a thyristor, is coupled to a resonant coil which, in turn, is coupled to the energy storage device. The solid state switch, which is not on the discharge path, initiates the reversal of polarity on the one capacitor by causing current to flow between the resonant coil and the one capacitor.

28 Claims, 6 Drawing Sheets

EXCITER CIRCUIT WITH SOLID SWITCH DEVICE SEPARATED FROM DISCHARGE PATH

FIELD OF THE INVENTION

This invention relates generally to exciter circuits of high-energy capacitive discharge ignition systems used for ignition of fuel in internal combustion engines and industrial burners and, more particularly, this invention relates to exciter circuits utilizing a solid-state switch, such as a thyristor, to initiate the discharge.

BACKGROUND ART

High energy capacitive discharge ignition systems are used to ignite either a main fuel or a pilot fuel in a variety of devices including internal combustion engines and industrial burners. Conventional capacitive discharge ignition systems include an exciter circuit to excite or energize an igniter plug. When the igniter plug is energized, it generates a spark to ignite the fuel. An exciter circuit includes an energy storage capacitor, a charging circuit to charge the capacitor, and a discharge circuit through which the energy storage capacitor is discharged into the igniter plug.

The discharge circuit includes a switching device connected in series between the storage capacitor and the igniter plug. Typically, such capacitive discharge ignition systems have used spark gap tubes with two electrodes as the discharge circuit switching device to isolate the energy storage capacitor from the igniter plug while the capacitor is being charged. When voltage on the capacitor reaches the spark gap break-over voltage, the capacitor discharges across the two electrodes of the spark gap tube and energizes the igniter plug where a spark is produced.

Repeated discharges through the spark gap tube cause electrode erosion and other detrimental changes within the tube having the effect of lowering the tube's break-over voltage. As a result, the voltage level attained in the storage capacitor prior to discharge and the energy transferred from the storage capacitor to the igniter plug at the time of discharge decline over the lifetime of the spark gap tube.

Recently, there have been proposals to replace the spark gap tube with a solid state switch. Unlike the spark gap tube, a solid state switch would not exhibit the degradation over repeated discharges of the energy storage capacitor. The solid state switch, typically a thyristor, has two main terminals, one being an anode the other being a cathode and a gate terminal. In its blocking or off state, the thyristor does not conduct current between its anode and cathode terminals thereby blocking flow of current from the energy storage capacitor to the igniter plug. In its conducting or on state, the thyristor conducts discharge current between the anode and cathode terminals thereby providing a current path between the energy storage capacitor and the igniter plug.

Conventionally, the anode and cathode terminals are used to directly replace the electrodes of the spark gap tube, the thyristor being connected in series between the storage capacitor and the igniter plug. In the blocking state, the thyristor sustains capacitor voltage and blocks current flow from the capacitor to the igniter plug while the capacitor is being charged. Once the capacitor is fully charged, the thyristor conduction or on state is triggered in response to a control signal applied to the gate terminal thereby initiating conduction between the cathode and anode terminals. Discharge current from the storage capacitor flows across the thyristor and into the igniter plug. The signal to the gate terminal is made responsive either conditionally or unconditionally to a circuit that senses full voltage across the storage capacitor.

A valuable advantage of using a thyristor in a discharge circuit of a discharge ignition system is that it has a demonstrated operating life over 25 times that of a spark gap tube. Additionally, storage capacitor voltage and energy at the time of discharge remain essentially constant over the life of the thyristor.

However, there are significant disadvantages to replacing a spark gap tube with a conventional thyristor switch. These disadvantages stem from the high peak power requirements at the igniter plug necessary to ignite fuel under adverse conditions. In a thin film semiconductor type igniter plug, that is an igniter plug with semiconductor material between the igniter plug electrodes, the required trigger voltage to generate a spark is on the order of 5000 volts (V). Within less than one microsecond after spark inception, voltage across the igniter plug electrodes decays to between 50 and 100 V and remains at this voltage level for an additional few microseconds (called the dwell period) before stabilizing at about 25 V.

When discharge current through the discharge circuit rises rapidly at a rate di/dt of between 500 and 1000 amps per microsecond (A/$\mu$s) during the dwell period, high peak power is generated by the coincidence of high igniter plug voltage (50–100 V) and peak current. If the rise of discharge current is delayed or the rate of rise is too low, the igniter plug electrode voltage will decay to the lower 25 V voltage level, before the peak current is attained and, therefore, peak power supplied to the igniter plug will be lower. Furthermore, inductive reactance in the discharge circuit, which opposes the rapid rise in current, requires that source voltage across the energy storage capacitor be above 2000 V. Accordingly, a spark gap tube in a typical discharge circuit sustains a source voltage of between 2000 V and 3000 V while the storage capacitor is charged and conducts discharge current that rises at a rate between 500 A/$\mu$S and 1000 A/$\mu$S to a peak of 2000 A.

Use of single thyristor, which can operate under the above conditions, to replace a spark gap tube in a discharge circuit has not been practical because such thyristors are large, expensive, and not readily available. In contrast, thyristors of moderate size and price which are generally available as off-the-shelf items are typically limited to an operating voltage of 1200 V, a pulse current peak of 1000 A and a current transition rate (i.e. di/dt) of 200 A/$\mu$S. Use of a single off-the-shelf thyristor with the above limitations results in reduced peak power and spark energy for the igniter plug.

Various designs to overcome these limitations have been proposed but each of these designs suffer from a number of disadvantages.

1. Use of a plurality of thyristors connected in series. Connecting two or three of these thyristors in a series string provides the 2000 V to 3000 V standoff capability necessary for high peak power but it also adds to circuit cost and complexity. In addition to the extra devices, additional components (typically a diode, resistor and capacitor) must be connected across each thyristor to insure that voltage across the series string is shared equally by each thyristor when they are blocking capacitor voltage and when they are turning on. Furthermore, the gate circuit for a single device expands to include additional devices.

2. Use of a saturable core inductor (sometimes referred to as a delay reactor). To allow conventional thyristors to conduct current with the high transition rate necessary for high peak power, a saturable reactor may be connected in series with the thyristor. Such an arrangement, however, does not always produce the expected beneficial results. One type of thyristor that is typically used in a discharge circuit is a silicon controlled rectifier (SCR) which is a unidirectional thyristor, conducting current in only one direction. The General Electric SCR Manual, 5th edition, section 5.5.1, p. 141–142 (copyright 1972) teaches that a high rate of change of di/dt of on-state current while an SCR is in the process of turning on is capable of destroying the SCR.

During the turn on process of an SCR, only a small portion of the silicon die area around the gate electrode attachment conducts current due to a finite spreading velocity. If a fast rising current is permitted at turn on, a high current density occurs in a small conducting area of the die resulting in high switching losses. These high losses create excessive heating and are of a destructive nature to the thyristor device. To allow proper current spreading over the entire silicon die area before fast rise current is permitted, a saturable core inductor, referred to as a delay reactor, must be placed in series with the thyristor switch. Initially, when the thyristor turns on, the inductance of the reactor is high. This limits the rate of rise of current (di/dt) to less than a destructive value, typically 200 A/$\mu$S, during the delay period that conduction current spreads across the die area.

Once the thyristor is in full conduction and current has risen to the level that causes magnetic saturation of the delay reactor's core material, the inductance becomes a small value. Current then rises safely at a rapid rate between 500 A/$\mu$S and 1000 A/$\mu$S. However, the use of a delay reactor to increase di/dt of the discharge current through a thyristor will not produce a high peak power if the igniter plug voltage is allowed to stabilize at a low level during the decay period. Stabilization of igniter voltage can be prevented by keeping igniter current below a few amps during the delay period while delay reactance is high. However, this is not practical since reliable spark initiation for worn or fouled igniter plugs requires at least 25 A spark current between the igniter plug electrodes.

Additionally, a delay reactor in the discharge circuit presents an obstacle to developing a sufficient trigger voltage at the exciter circuit output. Whereas voltage on a storage capacitor between 2000 V and 3000 V is sufficient to initiate and sustain a spark for one type of igniter plug (bulk or pellet semiconductor igniter plug), another type (thin film semiconductor igniter plug) requires 5000 V to reliably initiate the spark, and yet another igniter plug (surface gap igniter plug (sometimes incorrectly referred to as an air gap igniter plug)) requires 15000 V to 25000 V. Traditionally, a trigger circuit is connected between the discharge circuit switch and the exciter circuit output to generate the igniter plug's required spark inception voltage or trigger voltage in cases where it is higher than the capacitor's storage voltage. The trigger circuit generates a short duration (0.1 $\mu$S to 1 $\mu$S) high voltage pulse at the output of the exciter circuit that initiates the spark at the igniter plug.

After the spark is initiated and the high voltage pulse has passed, the spark is sustained by the lower voltage of the storage capacitor. A typical trigger circuit requires an input voltage with a fast rise time from a low impedance source. The high impedance output of the delay reactor is not compatible with the low impedance input required by the trigger circuit.

3. Use of a plurality of thyristors connected in parallel. The high current peak, typically 2000 A, conducted by the spark gap tube to produce high peak power at the igniter plug could be conducted by two or more thyristors with the above limitations when connected in parallel. But this approach suffers from the same disadvantage as using multiple devices to increase standoff voltage (i.e. multiple devices with their required ancillary circuits increase circuit cost and complexity).

Another problem not related to spark power or energy occurs after conduction of the discharge current when the thyristor must be allowed to recover its blocking state. If the thyristor does not recover its blocking state, it will conduct current from the charging power supply away from the storage capacitor and prevent recharge of the capacitor. The spark gap tube and thyristor are both regenerative devices and, as such, will switch out of conduction once their conduction current falls below a sustaining level that is characteristic of each device. The charging circuit charging current, which is typically less than one ampere, is below the sustaining current for a spark gap tube. Consequently, the spark gap tube turns off unaided after each discharge, allowing the storage capacitor to recharge. However, the thyristor has a much lower level of sustaining current (typically only 10 mA). Thus, a thyristor will be held in conduction by the charging circuit charging current that is typically above the thyristor sustaining current level unless other means are provided to momentarily reduce its conduction current to below the sustaining level.

One means of turning off a thyristor consists of momentarily turning off the charging circuit power supply until the thyristor has time to recover its blocking state. This method is practical for a power supply of the electronic high frequency switching variety wherein an existing electronics power switch can be cycled off and back on after each discharge with the addition of little or no extra control circuitry. It is more expensive to apply this method to a conventional charging power supply, which uses a line frequency, high voltage transformer to supply the charging current. In this case a power electronic switch with additional control circuitry must be added to cycle the transformer off and back on after each discharge.

Other methods of turning the thyristor off after each discharge that do not require the interruption of charging supply current work by diverting current away from the thyristor momentarily until the thyristor has time to recover its blocking state. One of these methods relies on resonant elements in the discharge circuit to reverse current momentarily in the thyristor at the end of each discharge pulse allowing the thyristor to turn off. These resonant circuit elements are inherently a part of some discharge circuits while in other discharge circuits such resonant circuit elements must be added increasing the cost of the circuit and resulting in loss of circuit efficiency.

Accordingly, there is a need for an exciter circuit that provides the igniter plug with both a rate of rise of current and a peak current that is substantially higher that the rise of current and peak current through the discharge circuit switch.

What is also needed is an exciter circuit that permits an increased storage capacitor voltage substantially above the voltage across the discharge circuit switch so that power supplied to the igniter plug is maximized and allows replacement of the spark gap tube with a single solid state discharge circuit switch.

What is also needed is an exciter circuit discharge circuit that provides the igniter plug with a fast rising current, which does not initially rise as a significantly lower rate thus allowing the igniter plug to attain high peak power before the igniter plug electrode voltage has had time to decay to a lower steady state voltage.

What is also needed is an exciter circuit trigger circuit that provides the igniter plug with an initial high voltage pulse to initiate the igniter plug spark at a voltage substantially above the source voltage across the storage capacitor.

What is also needed is an exciter circuit discharge circuit that inherently provides reverse current to the thyristor after each discharge pulse so that the thyristor has time to turn off without interrupting the flow of current from the charging circuit power supply or having to add additional circuit elements for turning the thyristor off.

SUMMARY OF THE INVENTION

It is an object of the present invention to provide an exciter circuit for a high-energy capacitive discharge ignition system that energizes an igniter plug with both a rate of rise of current and a peak current that is substantially higher than the rate of rise of current and peak current experienced by a solid state switch of a discharge circuit, the solid state switch preferably being a thyristor.

It is another object of the present invention to provide an exciter circuit having a maximum voltage across a pair of storage capacitors that is substantially above a maximum voltage across the discharge circuit switch so that power supplied to the igniter plug is maximized.

It is another object of the present invention to provide an exciter circuit generating a fast rising current for energizing the igniter plug and which does not initially rise at a significantly lower rate thus permitting the igniter plug to attain a high peak power before the igniter electrode voltage has had time to stabilize at a lower steady state voltage.

It is another object of the present invention to provide an exciter circuit having a trigger circuit that provides the igniter plug with an initial high voltage pulse to initiate a spark at a voltage substantially above the source voltage on the storage capacitors.

It is another object of the present invention to provide an exciter circuit having a discharge circuit that inherently provides reverse current to the thyristor after each discharge pulse. This is to allow the thyristor time to turn off without interrupting the flow of current from the charging supply or having to add additional circuit elements primarily for turning the thyristor off.

An exciter circuit of the present invention is suitable for use in an ignition system including an igniter plug placed within a region containing a combustible material. The exciter circuit includes:

a) an energy storage device including a plurality of energy storage elements;

b) a charging circuit for charging the plurality of energy storage elements to respective predetermined voltage magnitudes;

c) a discharge circuit electrically coupled to the energy storage device and an igniter plug and providing a conductive discharge path between the energy storage device and the igniter plug for periodically energizing the igniter plug by applying an output signal to the igniter plug, the discharge circuit output signal having a voltage magnitude sufficient to initiate a spark across electrodes of the igniter plug;

d) the discharge circuit including a polarity reversal circuit coupled to the energy storage device for periodically reversing a polarity of a charge stored by one energy storage element of the plurality of energy storage elements and discharging the energy storage device to generate an energy storage device output signal having a voltage magnitude that is greater than the predetermined voltage magnitudes of the plurality of energy storage elements; and e) the discharge circuit including a pulse forming circuit for converting the energy storage device output signal into the discharge circuit output signal applied to the igniter plug.

An ignition system of the present invention includes a) an igniter plug for placement within a region containing a combustible material for providing a spark to ignite said material, said igniter plug including an input electrode for receipt of an output signal for initiating said spark;

b) an igniter circuit for periodically generating the output signal to initiate the igniter plug spark, the igniter circuit including:

1) an energy source for providing electric energy at a source output;

2) a discharge circuit including an energy storage device electrically coupled to the energy source source output for storing electrical energy from the energy source in a plurality of energy storage elements, each of the plurality of energy storage devices being charged to a respective predetermined voltage magnitude; and 3) the discharge circuit further including a polarity reversal circuit coupled to the energy storage device for periodically reversing a polarity of a charge stored by one of the plurality of energy storage elements, the discharge circuit discharging the plurality of energy storage elements and generating the output signal wherein a voltage magnitude of the output signal is substantially equal to a sum of the respective predetermined voltage magnitudes of the plurality of energy storage elements.

These and other objects, advantages, and features of an exemplary embodiment of the present invention are described in detail in conjunction with the accompanying drawings.

DETAILED DESCRIPTION OF THE EXEMPLARY EMBODIMENT OF THE INVENTION

Figure 1:
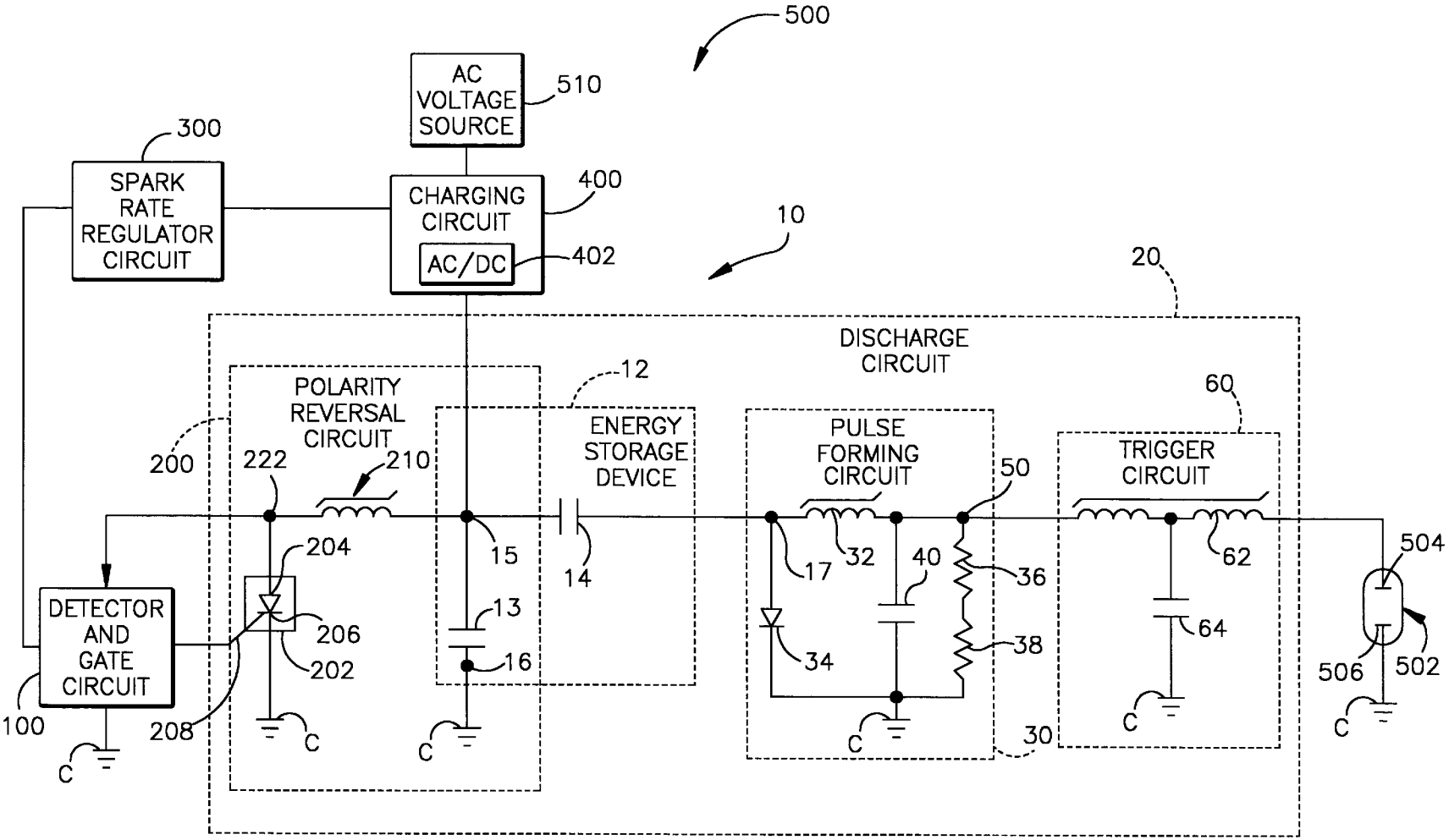
FIG. 1 is a block diagram of an ignition system including an exciter circuit constructed in accordance with a first preferred embodiment of the present invention.

Turning to FIG. 1, an exemplary embodiment of an exciter circuit of the present invention is shown in a block diagram and is designated generally at 10. The exciter circuit 10 is used in connection with an high energy capacitive discharge ignition system 500 to initiate combustion of a combustible fuel in a burner (not shown) or an internal combustion engine (not shown) by energizing an igniter plug 502 above a threshold trigger voltage thereby causing a spark across a pair of electrodes 504, 506 of the igniter plug 502 (506 being at circuit common C). The exciter circuit 10 includes a capacitive energy storage device 12, a discharge circuit 20, a detector and gate circuit 100, a polarity reversal circuit 200, a spark rate regulator circuit 300, and a charging circuit 400. Power to the exciter circuit 10 is provided by an AC power source 510. The discharge circuit 20 includes a polarity reversal circuit 200 (shown in dashed line in FIGS. 1 and 2B), a pulse forming circuit 30 and a trigger circuit 60.

Figure 2A:
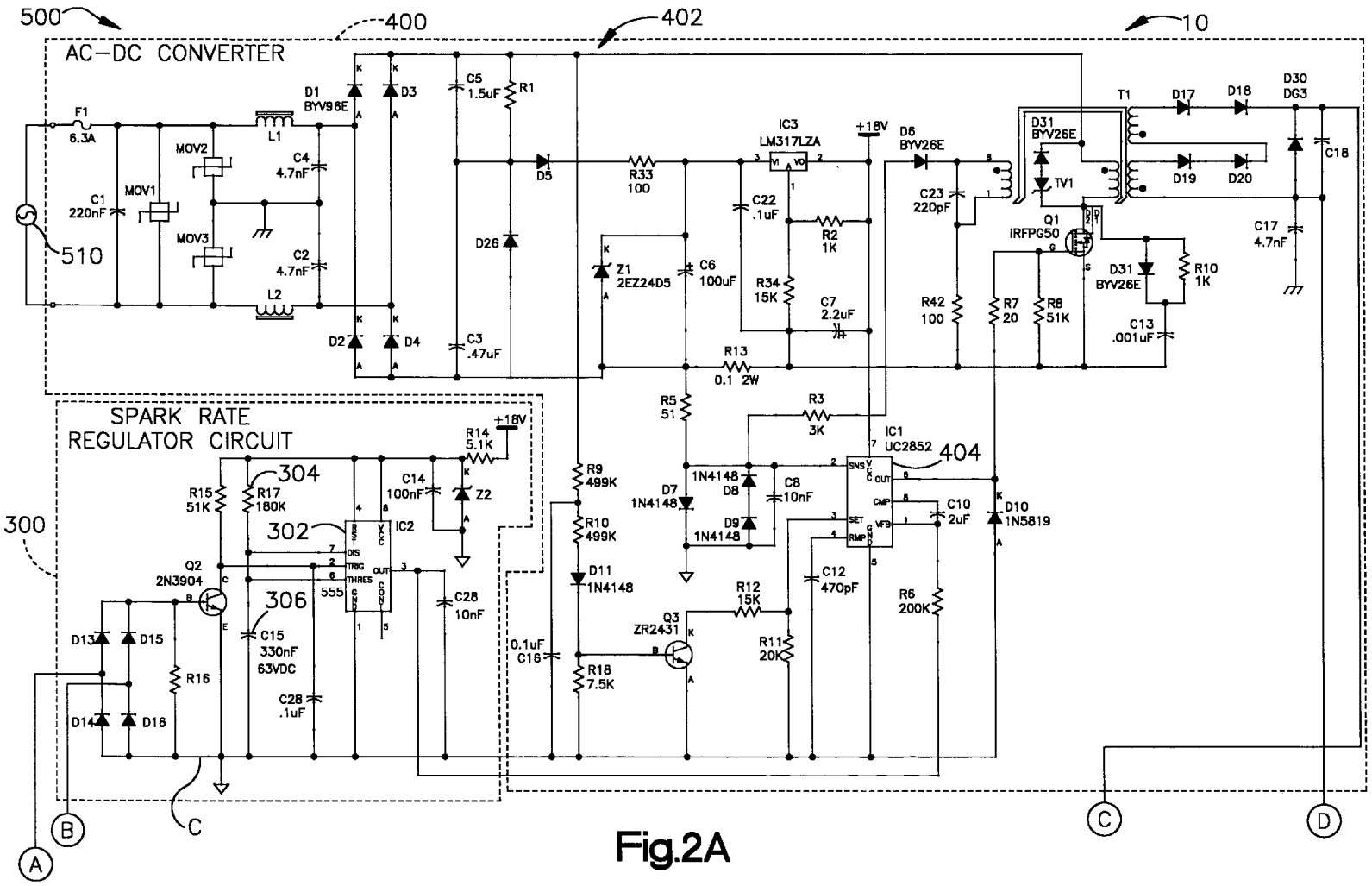
FIG. 2A is a first portion of a schematic diagram of the exciter circuit of FIG. 1.
Figure 2B:
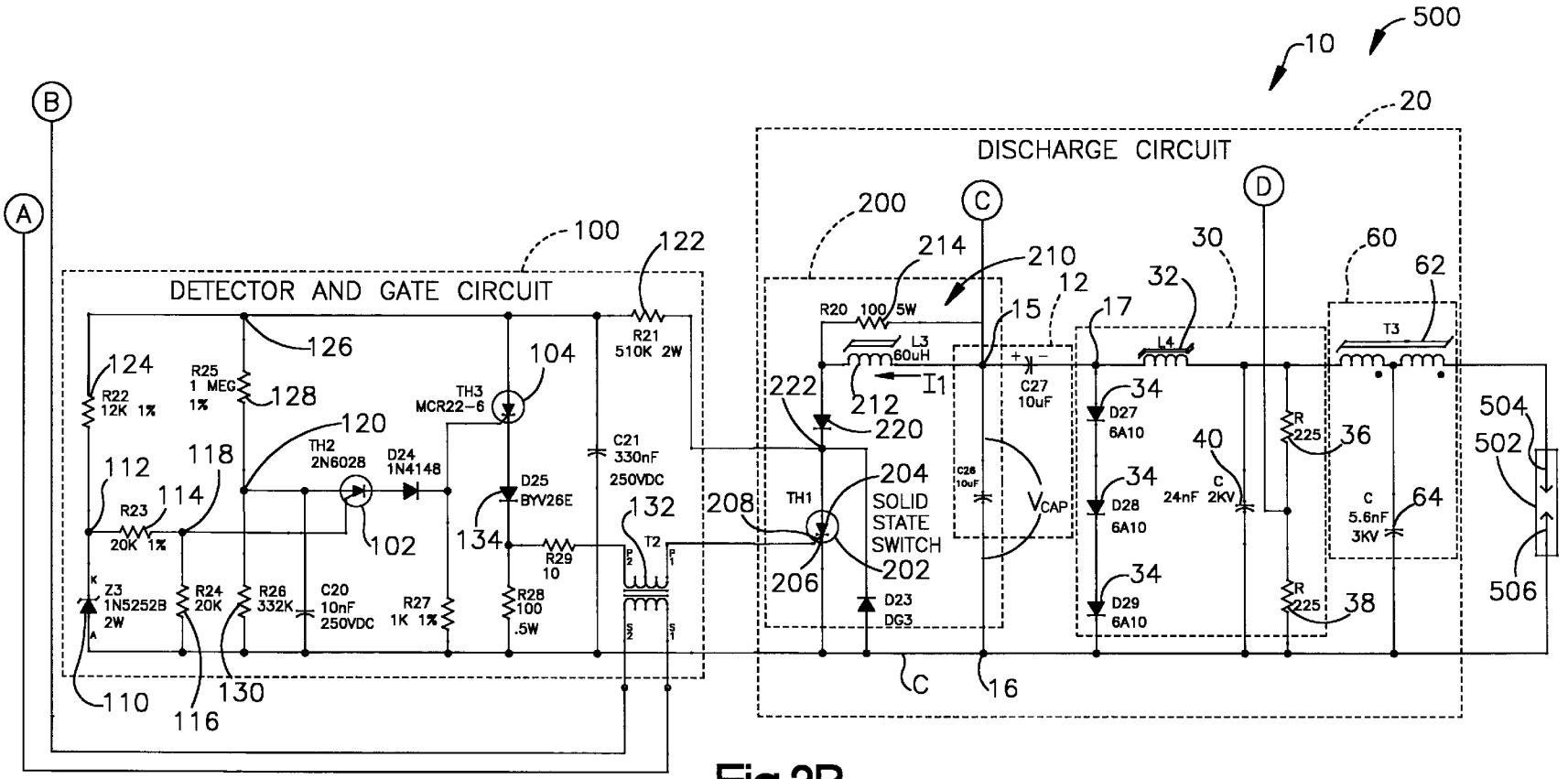
FIG. 2B is a second portion of a schematic diagram of the exciter circuit of FIG. 1 that matches the portion of the exciter circuit shown in FIG. 2A.

Depending on the type of igniter plug 502 that is used in the ignition system 500, the discharge circuit 20 may need to be slightly modified from the circuitry shown in FIGS. 1, 2A, and 2B. Specifically, the embodiment of the exciter circuit 10 shown in FIGS. 1, 2A, and 2B assumes that the igniter plug 502 is a thin film semiconductor igniter plug which requires a relatively high trigger voltage (up to approximately 5000 V) to be applied to the igniter plug 502 to trigger conduction across the igniter plug electrodes 504, 506. This high trigger voltage necessitates the inclusion of the trigger circuit 60 in the discharge circuit to boost the voltage applied to the negative electrode 504 of the igniter plug 504 to a suitable high magnitude voltage. As will be explained below, if a bulk or pellet semiconductor igniter plug (which will be designated as 502') is used in place of the thin film semiconductor air gap igniter plug 502, a substantially lower threshold voltage level (approximately 1500 V) is required to initiate conduction across the igniter plug electrodes 504, 506. If such a lower threshold voltage igniter plug is used, the trigger circuit 60 is not required in the discharge circuit 20.

Overview of operation of exciter circuit 10

The charging circuit 400 constantly supplies charging power to the energy storage device 12 consisting of two 10 microfarad ($\mu$F) capacitors 13, 14. During the charging cycle, the polarities of the capacitors 13, 14 are series opposing relationship with respect to the igniter plug 502. The series opposing relationship means that as the capacitors 13, 14 are charged to their maximum voltages (1200 V) their polarities are opposing such that with respect to the igniter plug 502, the capacitors 13, 14 have a combined net potential of substantially 0 V even though each capacitor has a maximum charge of approximately 1200 V.

When the voltage on the capacitor 13 exceeds a magnitude of 1200 V, a PUT (programmable unidirectional thyristor) 102 (FIG. 2B) of the detector and gate circuit 100 turns on, this in turn, turns on a larger amperage drive thyristor 104. Turning on the drive thyristor 104, in turn, turns on a gate terminal 208 of a solid state switch 202 of the polarity reversal circuit 200. When the solid state switch 202 is turned on, a resonant coil 210 of the polarity reversal circuit 200 effectively reverses polarity of the 1200 V charge across capacitor 13. When the voltage across capacitor 13 is reversed, the charges on the two capacitors are in series additive relationship (1200 V+1200 V) with respect to the igniter plug 502.

The capacitor voltage is amplified and shaped by the pulse forming circuit 30 (increasing the voltage from 2000 V to approximately 3000 V) and stepped up from 3000 V to 5000 V magnitude by the trigger circuit 60. The stepped up voltage of the trigger circuit 60 is output to the igniter plug electrode 504.

It is important to note that the solid state switch 202 is not in the discharge path between the capacitors 13, 14, the pulse forming circuit 30, the trigger circuit 60 and the igniter plug electrodes 504, 506.

Those skilled in the art will readily appreciate that the advantages and benefits of exciter circuit 10 of the present invention can be realized with alternate exciter circuit designs and the present invention is not to be considered limited to the exemplary embodiment. Such designs include, but are not limited to, unidirectional discharge, oscillatory discharge, AC and/or DC charging systems, spark gap and solid state switching circuits, high tension and low tension discharge circuits, and the like. Furthermore, it is possible to use the invention in combination with various high-energy capacitive discharge ignition systems suitable for different types of internal combustion engines, industrial burners and pilots.

Energy storage device 12

As noted above, the energy storage device 12 is comprised of the two 10 $\mu$F capacitors 13, 14. As can best be seen in FIG. 2B, the first capacitor 13 is coupled between a node 15 of the energy storage device and a node 16 coupled to circuit common C. The second capacitor 14 is coupled between a midpoint terminal 15 and a output node 17. During the discharge cycle, the voltage at node 17 is the voltage across both the capacitors 13, 14 labeled $V_{CAP}$ in FIG. 5. The voltage $V_{CAP}$ is coupled to a pulse forming circuit 30 which is part of the discharge circuit 20.

Discharge circuit 20

In a first preferred embodiment of the discharge circuit 20, the discharge circuit includes the polarity reversal circuit 200, the pulse forming circuit 30 and the trigger circuit 60. In a second preferred embodiment (shown in FIG. 7), a lower voltage bulk semiconductor igniter plug 502' is substituted for the thin film semiconductor igniter plug 502, this permits the trigger circuit 60 to be eliminated.

The spark inception voltage for the igniter plug can be as high as 15000 V for a conventional surface gap igniter or it can be as low as 2000 V for a bulk or pellet semiconductor igniter plug. The exciter circuit 10 of the first preferred embodiment requires the use of the trigger circuit 60 because it is assumed that the igniter plug 502 is a thin film semiconductor igniter plug (or, alternatively, a conventional surface gap igniter plug). The trigger circuit 60 increases the voltage applied to the conductor electrode 504 to up to 5000 V for the thin film semiconductor igniter plug 502 (or if a conventional surface gap igniter plug were to be substituted, the trigger circuit 60 would increase the voltage applied to up to 15000 V).

The discharge circuit path consists of the series connected elements including the capacitors 13, 14, the saturable reactor 32, the trigger circuit autotransformer 62 and igniter plug 502 which is connected back to circuit common C.

Pulse forming circuit 30

The pulse forming circuit or network 30 enhances discharge circuit performance by presenting the igniter plug 502 with a voltage rate of rise and voltage amplitude that is increased over that which appears at the output terminal 17 of energy storage device 12. Typically, voltage rate of rise increases from 100 V/$\mu$S to 2000 V/$\mu$S and voltage amplitude increases from 2000 V to 3000 V.

The pulse forming circuit 30 is comprised of a saturable reactor 32, a free wheeling diode 34, a pair of steering resistors 36, 38, and a resonant capacitor 40. The free wheeling diode 34 actually comprises three diodes 34*a*, 34*b*, 34*c* in series as is shown in FIG. 2B. The saturable reactor 32 typically consists of 25 to 50 turns of insulated wire wound around a magnetic core. The magnetic core is typically a toroid wound from a thin strip of magnetic metal that possesses properties of high saturation flux density, high permeability, and a square-loop B-H curve.

The capacitor 40 resonates with the saturated inductance of the saturable reactor 32. A ceramic disc or multi-layer capacitor rated 2000 to 4000 volts is suitable. Dielectric material can be Linear Class I (such as N2800) or Non-Linear Class II (such as X7R). Use of a non-linear capacitor will maximize the output voltage of the pulse-forming network 30.

Trigger circuit 60

Where a trigger voltage with amplitude greater than 3000 V must initiate the spark in igniter plug 502, trigger circuit 60 is used to augment the output voltage of pulse forming circuit 30. Trigger circuit 60 is a resonant circuit that consists of autotransformer 62 and a 5.6 nanofarad capacitor 64 that is chosen to resonate with the primary inductance of autotransformer 62. The autotransformer consists of 20 to 30 turns of insulated wire around a toroidal powdered metal core. Typically the secondary to primary turns-ratio of the autotransformer 62 is 1:1 but higher ratios provide higher trigger voltages to the igniter plug 502.

Properties of resonating capacitor 64 are similar to those of resonating capacitor 40 used in the pulse forming circuit 30 except the voltage rating of the capacitor 62 is preferably 4000 to 6000 volts.

Discharge cycle

During the discharge cycle (that is, when the solid state switch 202 is on), since the igniter plug electrode 506 is at circuit ground or common C, the voltage differential across the electrodes 504, 506 is substantially 5000 V triggering conduction (a spark) across the electrodes.

At the end of the capacitor charge cycle and beginning with the gate signal from drive thyristor 104 to the solid state switch 202, a time sequence of four events takes place that starts with the reversal of voltage on the capacitor 13 and ends with the circulation of discharge current through igniter plug 502. The voltage across the igniter plug electrodes 504, 506 is shown in Figure labeled as $V_{IP}$ in FIG. 6.

Event 1 (0 $\mu$s through 25 $\mu$s)

Figure 4A:
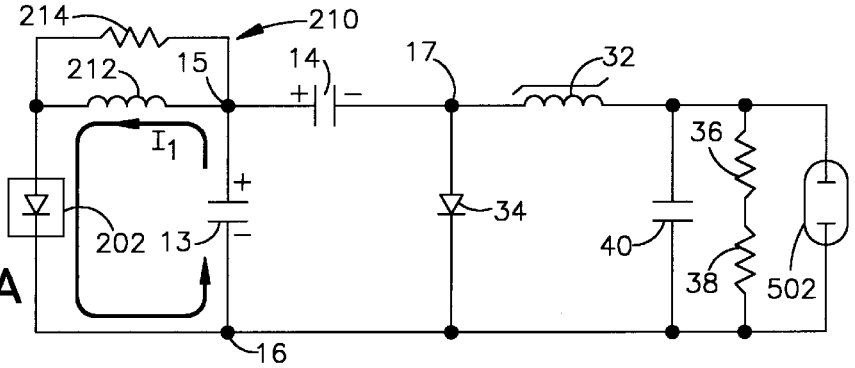
FIGS. 4A, 4B and 4C are simplified schematic diagrams of a discharge circuit of the exciter circuit.
Figure 5:
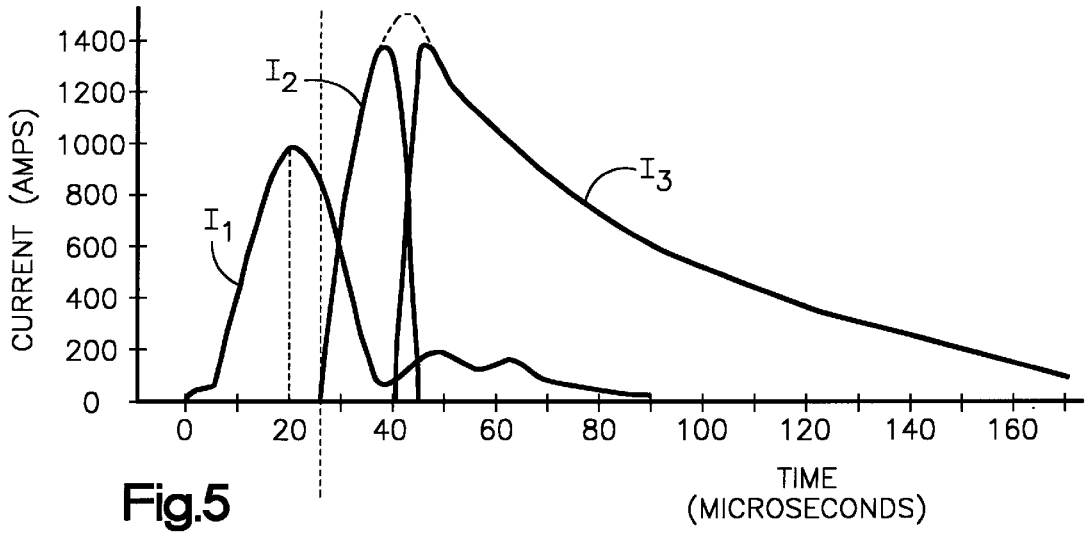
FIG. 5 is a graph of current waveforms of the discharge circuit.

Polarity reversal of voltage across the capacitor 13 and at node 15 is caused by the action of polarity reversal circuit 200. The arrow labeled I1 in FIG. 4A and the waveform labeled I1 in FIG. 5 represent the current through the solid state switch 202. The duration of event 1 lasts approximately 25 microseconds (25 $\mu$s). The current in solid state switch 202 is also the current in the polarity reversal circuit 200. During event 1, no current flows through the igniter plug electrodes 504, 506.

Figure 6:
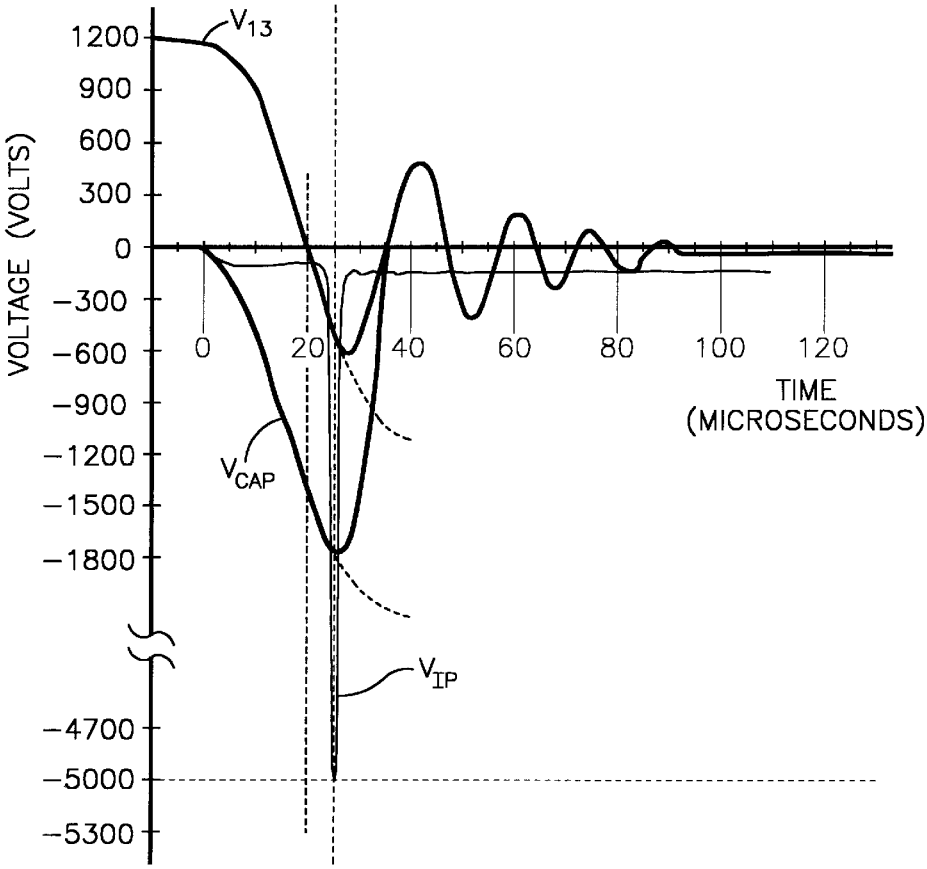
FIG. 6 is a graph of voltage waveforms of the discharge circuit.

The voltage labeled $V_{13}$ in FIG. 6 is the voltage waveform across the capacitor 13 (that is, the voltage at node 15). The dashed line extending downwardly from $V_{13}$ indicates that capacitor 13 would recharge to a −1200 V if event 1 was not terminated at 25 microseconds by the saturation of the saturable reactor 32 which will be explained below.

The reversal of voltage $V_{13}$ on the capacitor 13 is accompanied by a build up (in a negative direction) of voltage at node 17 which is the output of energy storage device 12. The voltage at node 17, which is labeled $V_{CAP}$, is the sum of the voltage $V_{13}$ across the capacitor 13 plus the negative 1200 V that appears across the capacitor 14. Thus, the total voltage across the capacitors 13, 14 $V_{CAP}$ is the sum of the voltage $V_{13}$ across capacitor 13, which is swinging in a consign curve like fashion from +1200 V toward a −1200 V, and the voltage across capacitor 14, which remains constant at −1200 V during event 1. Note the dashed line of $V_{CAP}$ in FIG. 6 shows that the total output voltage of the capacitors 13, 14 would have dropped to −2400 V if event 1 was not terminated by the saturation of the saturable reactor 32.

The total output voltage $V_{CAP}$ of the capacitors 13, 14 appearing at node 17 is delayed for an interval of time from appearing across igniter 502 by the high unsaturated series impedance of the saturable reactor 32 and the low shunt impedance of the capacitor 40 in parallel with the series combination of the two resistors 36, 38 of the pulse forming circuit 30.

The delay interval which also marks the termination of event 1 is determined by the time that it takes the saturable reactor 32 to become saturated and switch to a low impedance state. This delay interval is determined by a relationship such that the time integral of voltage across the saturable reactor 32 is equal to a design constant known as volt-sec capability. The voltage appearing across saturable reactor 32 during the delay interval, approximately 25 $\mu$s, is essentially the output voltage $V_{CAP}$ at node 17 because voltage, $V_{IP}$, across the igniter 502 is insignificant.

Event 2 (25 $\mu$s through 26 $\mu$s)

Event 2 occurs during the time that the saturable reactor 32 is switching from high to low impedance and immediately thereafter. The duration of event 2 is less than 2 $\mu$s and is typically 1 $\mu$s. During event 2, the output voltage $V_{CAP}$ at node 17 is approximately −2000 V. The output voltage $V_{CAP}$ rings though the resonant circuit comprised of the inductance saturated reactor 32 and the resonant capacitor 40. This appears as a −3000 V trigger pulse with a 1 $\mu$s rise time at node 50, the output node of the pulse forming circuit 30. The current through the igniter plug electrodes 504, 506 during events 2, 3 and 4 is shown in FIG. 5. The total igniter plug current during events 2, 3 and 4 is the sum of the current waveforms I2 and I3, specifically, looking at FIG. 5, the total igniter plug current comprises the left hand side of the current waveform I2, the dashed line portion bridging the peaks of current waveforms I2 and I3, representing the sum of the two waveforms, and the right hand portion of current waveform I3.

Figure 7:
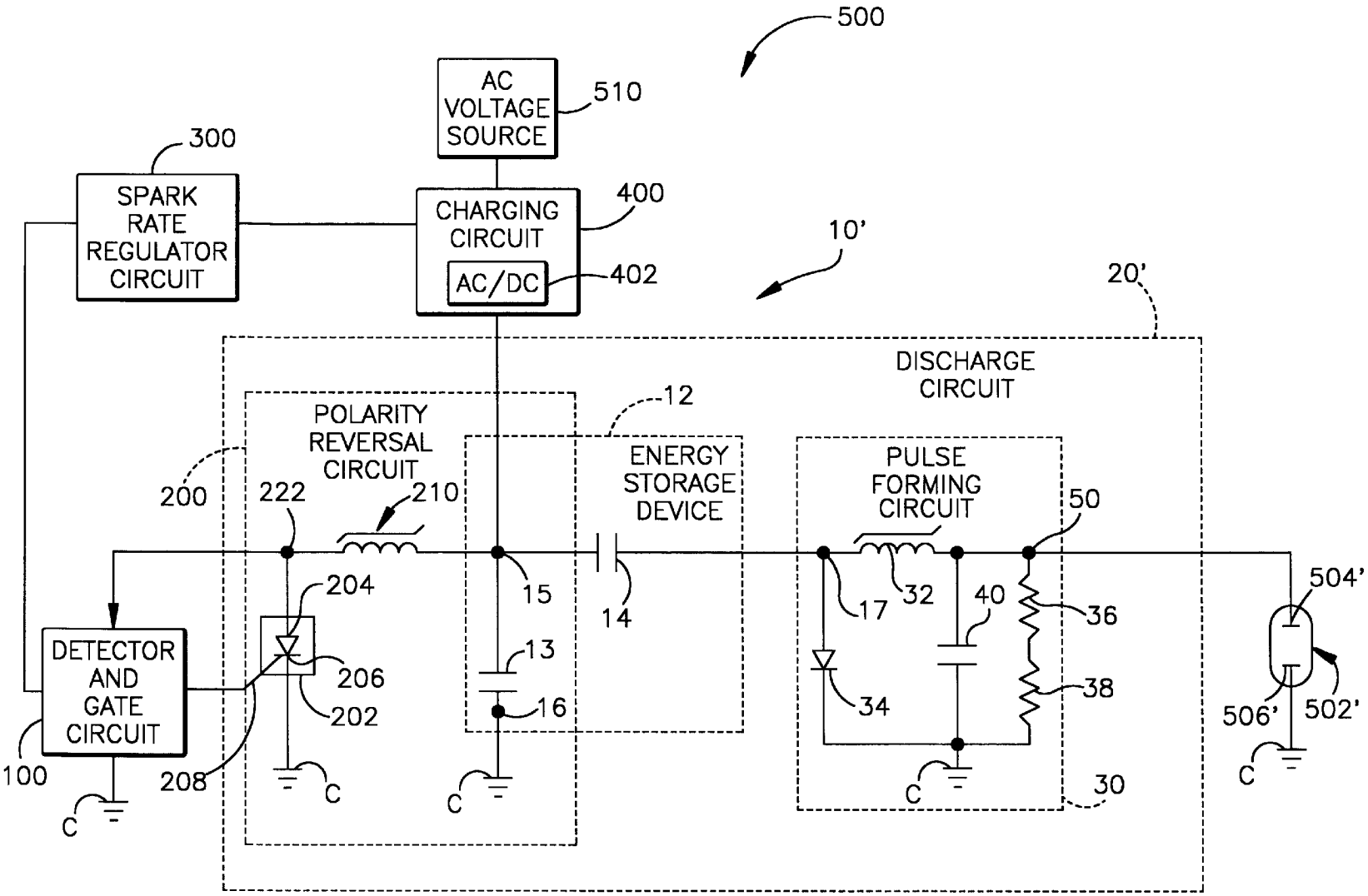
FIG. 7 is a portion of a schematic diagram of a second preferred embodiment a exciter circuit of the present invention for use with a semiconductor igniter plug.

As will be explained below, in a second embodiment of the present invention the exciter circuit 10' does not include the trigger circuit 60, thus, the output node 50 of the pulse forming circuit 30 would be connected to the bulk semiconductor igniter plug 502' as shown in FIG. 7 since the −3000 V trigger pulse is sufficient to create spark inception in the bulk semiconductor igniter plug 502'. In the first embodiment of the exciter circuit 10, 5000 V is required for spark inception of the thin film igniter plug 502 and the trigger circuit 60 is used.

In the preferred first embodiment, the pulse forming circuit 30 includes the linear capacitor 40 is used and the trigger circuit 60 is connected to the output of the pulse forming circuit 30 to further boost the output voltage of the exciter circuit 10 to −5000 V to trigger the igniter plug 502.

Another way to increase the trigger pulse voltage to the required 5000 V is to choose a nonlinear capacitor for the capacitor 40. Using a nonlinear capacitor in a resonant circuit allows the ring up voltage to be more than twice the source voltage.

Event 3 (26 $\mu$s through 35 $\mu$s)

Event 3 begins after the trigger voltage generated during event 2 has produced spark inception in the igniter plug 502 and the igniter plug voltage, $V_{IP}$, that is, the voltage across the igniter plug electrodes 504, 506 has fallen to less than −100 V which typically occurs in less than 1 $\mu$s after spark inception.

Figure 4B:
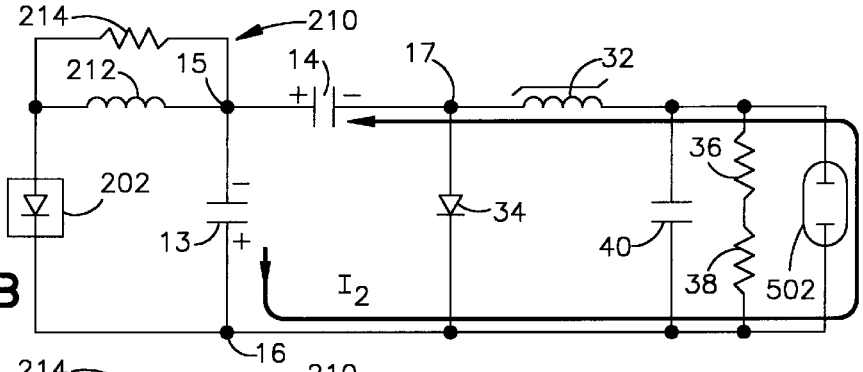

Event 3 traces the build up of discharge current labeled as $I_2$ in the path shown in FIG. 4B and by the graph of discharge current $I_2$ shown in FIG. 5. During the interval of event 3, which extends from 26 $\mu$s to 35 $\mu$s in FIGS. 5 and 6, the voltage $V_{CAP}$ across capacitors 13 and 14 at node 17 and shown in FIG. 6 forces the current (labeled $I_2$ in FIGS.

4B and 6) to rise in the saturated inductance of reactor 32 and the igniter plug 502. The igniter plug voltage $V_{IP}$ which drops less than 100 V offers little opposition to current flow where the source voltage from the capacitors 13, 14 is initially 2000 V.

At the end of event 3 (at approximately 35 μs) the voltage across capacitors 13 and 14 at node 17 and depicted as $V_2$ in FIG. 6 has declined to zero indicating the capacitors have been fully discharged.

However, most of the energy ($E=\frac{1}{2} CV_{CAP}^2$) originally stored in the capacitors 13, 14 now resides in the saturated inductance of the saturable reactor 32. Note that current is at a peak and inductor energy equals $E=\frac{1}{2} LI_2^2$). It is this source of energy that will maintain current flow during event 4.

Event 4 (35 μs through 180 μs)

Figure 4C:
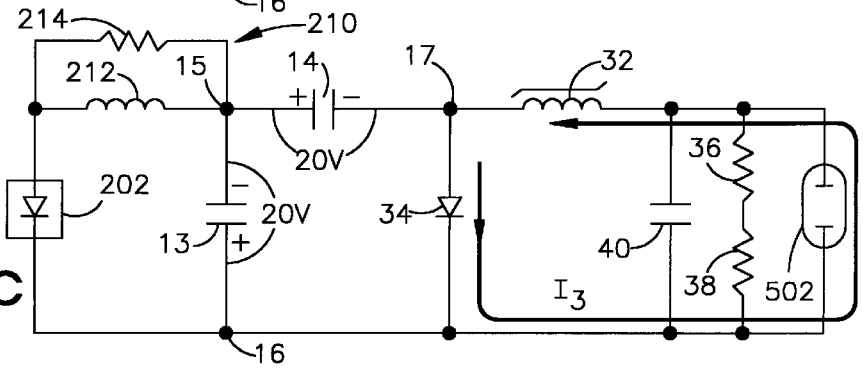

Event 4 extends from 35 μs to 180 μs and traces the flow of current $I_3$ through the igniter plug 502, the saturable reactor 32 and the free wheel diode 34 in the path shown in FIG. 4C. The magnitude and timing of the $I_3$ waveform appears in FIG. 5.

At the start of event 4, current is at its peak and energy originally stored in the capacitors 13, 14 as $E=\frac{1}{2} CV_{CAP}^2$ is now stored in the saturated inductance of reactor 32 as $E=\frac{1}{2} LI_2^2$. The energy $\frac{1}{2} LI_2^2$ is somewhat less than $\frac{1}{2} CV_{CAP}^2$ due to energy dissipated in the igniter plug 502 during event 3. During event 4, the energy stored in saturable reactor 32 is transferred to the igniter plug 502 as circulating current decays in the circuit consisting of saturable reactor 32, the free wheel diode 34 and the igniter plug 502. The free wheel diode 34 bypasses current around the capacitors 13,14 preventing their being recharged.

As the current through the igniter plug (labeled I3 in FIGS. 4C and 5) decays in the path shown in FIG. 4C, so do flux linkages in the winding of saturable reactor 32 which produces a voltage across the winding that opposes the decay of current. Thus, saturable reactor 32 becomes a voltage source to circulate current in the discharge path as it gives up its energy to the igniter plug 502.

Polarity reversal circuit 200

The polarity reversal circuit 200 is comprised of the energy storage capacitor 13 connected to a resonant coil circuit 210 (comprising a 10 microhenry coil 212 connected in parallel with a 100 ohm resistor 214). The resonant coil circuit 210 connects to the anode 204 of solid-state switch 202. The cathode 206 of the solid state switch 202 connects back to circuit common C. The function of the polarity reversal circuit 200 is to reverse voltage polarity on the capacitor 13 once the capacitors 13, 14 are fully charged.

Conduction in the polarity reversal circuit 200 starts with the capacitors 13, 14 fully charged and the current (labeled I1 in FIGS. 4A and 5) through the resonant coil circuit 210 at 0 A. As can be seen in FIG. 5, the resonant coil circuit current I1 then increases sinusoidally to a peak current, typically 500 to 1000 amperes, at about 20 μs as voltage (labeled $V_{CAP}$ in FIG. 6) across the capacitor 13 decreases as a cosine to cross 0 V at 20 μs. At 20 μs, the energy stored on capacitor 13 has been transferred to resonant coil 212. From 20 μs through approximately 35 μs, the coil 212 becomes a current source that decays sinusoidally back toward I1=0 A as it recharges the capacitor 13 in the opposite direction.

Detector and gate circuit 100

The detector and gate circuit 100 senses when the capacitors 13, 14 are fully charged and in response forces solid state switch 202 into conduction by applying a current pulse, typically 3 to 5 amperes, to a gate terminal 208 of the solid state switch 202.

The voltage across the capacitors 13, 14 (less a diode drop due to diode 220) is present at the node 222 and at the anode 204 of the solid state switch 202. A 24 V Zener diode 110 results in a 24 V voltage at node 112 and a 1:1 voltage divider comprising a pair of 20 K ohm resistors 114, 116 results in a 12 V at a center node 118 between the resistors. Thus, a voltage of 12 V is applied to the gate of the PUT 102 throughout most of the charge cycle. When the capacitor 13 is charged to a voltage of 1200 V, that is, $V_{13}$=1200 V, the voltage at node 120 connected to the anode of the PUT 102 exceeds the voltage at node 108 connected to the gate of the PUT 102, the PUT will switch to its conductive state.

By virtue of a voltage divider comprising 510 K ohm resistor 122, 12 K ohm resistor 124, and the 24 V Zener diode 110, the voltage at node 126 approaches 48 V as the capacitor 13 charges to 1200 V. A 3:1 voltage divider comprising 1 MEG ohm resistor 128 and 332 K ohm resistor 130 result in a voltage at node 120 that is substantially 1/100 the voltage across the capacitor 13. Thus, as the voltage on the capacitors 13, 14 exceed 1200 V, the voltage at node 120 and applied to the anode of the PUT 102 exceeds 12 V. This cause the PUT 120 to switch to its conductive state. The current output of the PUT 102 is around 500 mA, which is too low to turn the solid state switch 202 on. Thus, the gate of the drive thyristor 104 is connected to the cathode of the PUT 102 such that when the PUT 102 is switched to its conducting state the drive thyristor 104 is turned on thereby energizing a transformer 132. The transformer 132 has a one turn primary winding and a secondary winding coupled to the spark rate regulator circuit 300.

When the drive thyristor 104 is energized, the voltage at node 126 (approximately 48 V less a diode drop due to diode 134) is applied to the gate 208 of the solid state switch 202 turning it on. The current supplied to the gate 208 by the drive thyristor 104 is on the order of 3–5 A.

The solid state switch 202 is turned off because of a residual negative voltage (about −20 to −50 V that exists across the capacitor 13 after event 4. The negative voltage on capacitor 13 is present at the anode 204 of the solid state switch 202 (less a diode drop) and turns the solid state switch off. The negative voltage across the capacitor 13 is balanced by an opposite polarity voltage of the same magnitude across the capacitor 14, thus, resulting in a net voltage of 0 V across both the capacitors 13, 14. The voltages across the capacitors 13, 14 during event 4 are shown in FIG. 4C. The waveform of the voltage across the capacitor 13 is shown in FIG. 6 and, as can be seen, the voltage during event 4 stabilizes at a slight negative voltage. The source of the charge that produces the 20–50 V voltage on the capacitors 13, 14 is the polarity reversal circuit resonant coil 212, which has stored energy from the polarity reversal during event 1 and acts as a residual current source to charge the capacitors during event 4.

Spark rate regulator circuit 300

The spark rate regulator circuit 300 is connected to the secondary windings of the detector and gate circuit transformer 132. When the detector and gate circuit 100 generates a current to turn the solid state switch 202 on, a current is induced in the secondary windings of the transformer 132.

The spark rate regulator circuit 300 consists of a 555 timer integrated circuit chip 302. The 555 timer is configured as a monostable multivibrator that is triggered at pin 2 of the IC 302 once each discharge cycle by the gate drive signal generated by the drive thyristor 104 and coupled to the solid state switch 202 via the current transformer 132.

Since the output pulse at pin 3 of the IC 302 is of constant amplitude and constant duration, the spark regulator circuit 300 behaves like a tachometer, that is, the average voltage of the output pulse train at pin 3 is proportional to the input pulse repetition rate at pin 2 of the IC 302.

The integrated circuit chip 404 of the AC to DC converter 402 is a power factor controller/switching regulator that increases capacitor charging power when voltage to IC 404 pin 1, the error amplifier voltage feedback pin, is below 5 V and conversely decreases capacitor charging power when voltage to pin 1 is above 5 V.

The average output voltage from pin 3 of IC 302 in the tachometer circuit is adjusted for 5 V with the desired spark rate providing the trigger input to IC 302 pin 2 by selection of a resistor 304 and a capacitor 306 coupled to pins 6 and 7 of IC 302. These components control the duration of the output pulse at pin 3 of IC 302.

Charging circuit 400

The charging circuit 400 includes the AC to DC converter 402 which is energized by the AC voltage source 510. The AC/DC converter 402 is electrically coupled to the energy storage device 15 including the energy storage capacitors 13, 14 to provide charging power to the capacitors.

A suitable AC voltage source 510 will range between 85 V to 265 V AC and 50/60 Hz. The AC voltage source 510 is coupled to the AC/DC converter 402. In the preferred embodiment, the AC to DC converter 402 is a high frequency switching power supply and a power factor converter. The AC/DC converter 402 forces the current waveform from the AC voltage source 510 to approximate the voltage waveform both in shape and phase with the result that RMS level and harmonic distortion of the current waveform is kept low. However, any AC/DC converter that raises the AC source voltage and provides a current limited DC output can be used in the exciter circuit 10, including a line frequency high voltage transformer with rectified output current typically used with spark gap exciters.

Alternately, a DC voltage source can be used in place of the AC voltage source 510, and in such an embodiment, a DC to DC converter would be used in place of the AC/DC converter 402.

The output of the AC/DC converter 402 supplies charging current to the energy storage capacitors 13, 14. Typically these capacitors are charged to 1200 V and store between 2 joules and 25 joules of energy depending on the application. The AC/DC converter 402 connects to terminal 15, the node between the two capacitors 13, 14. The other end of the capacitor 13 is connected to circuit common C. The other end of the capacitor 15, i.e. terminal 17, is connected through the pulse forming circuit 30 and the trigger circuit 60 to the high potential terminal of an igniter 70.

Charging cycle

During the period between spark discharges typically 0.05 to 1.0 seconds, the solid state switch 202 is off and AC-DC converter 402 charges capacitors 13, 14 through the terminal 15 connecting the capacitors. Voltage at terminal 14 increases from 0 to 1200 volts with respect to circuit common C.

Figure 3:
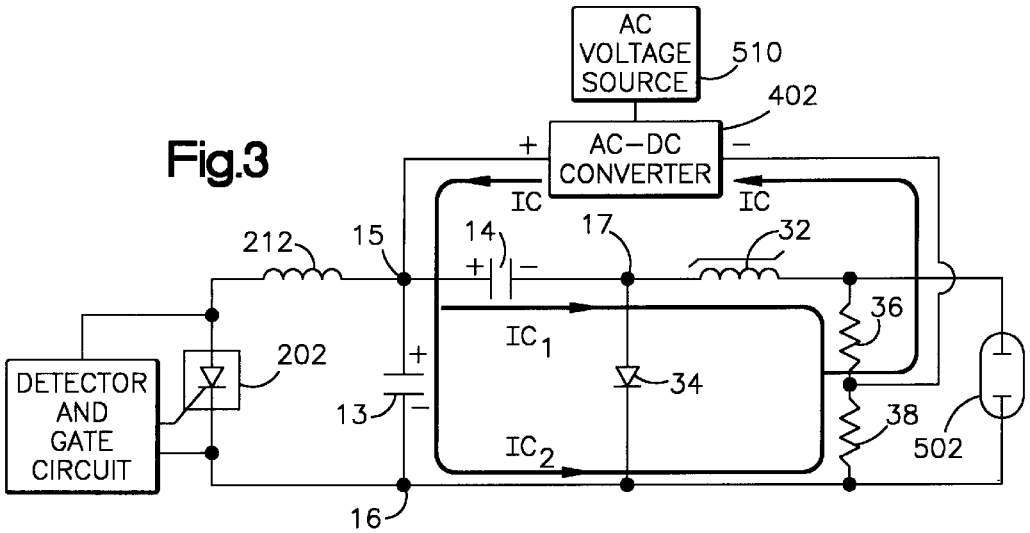
FIG. 3 is a simplified schematic diagram of a charging circuit of the exciter circuit of the present invention.

FIG. 3 indicates charging current flow during the charging cycle. The total charging current flowing from the AC/DC converter 402 is designated as IC. The current IC is approximately evenly split between IC1 and IC2 which follow respective current paths shown in FIG. 3. IC2 charges the capacitor 13 and returns to the AC/DC converter 402 through the steering resistor 38. IC1 charges the capacitor 14 and returns to the AC/DC converter 402 through the saturable reactor 32 and the steering resistor 36. The direction of the current IC1 through the saturable reactor 32 is opposite to the direction taken by discharge current I3 shown in FIG. 4C.

Because the saturable reactor 32 exhibits a square loop B-H curve, its magnetic core remains saturated after the discharge current I3 has decayed to 0 A. The magnetic flux in the core must be reset in the opposite direction after each discharge. This allows the saturable reactor 32 to provide the high unsaturated impedance needed to delay the voltage on the capacitors 13, 14 from appearing across the igniter plug 502 during event 2, as previously explained. Therefore, IC1 in addition to charging the capacitor 14 also resets the magnetic flux in the core of the saturable reactor 32 for the next discharge.

Both IC1 and IC2 are less than or equal to 500 milliamps (mA). The terminal labeled 17 is the node between the energy storage capacitor 14, the saturable reactor 32 and the diode 34 (which is actually comprised of three diodes 34*a*, 34*b*, 34*c* connected in series as can be seen in FIG. 2B) of the pulse forming circuit 30. Voltage at the terminal 17 remains near 0 volts during the charge cycle due to the low level of charging current, typically less than 500 milliamperes, that passes through the saturable reactor 32 and the steering resistors 36, 38.

During the charge period or cycle, there is no electromotive force in the discharge circuit to create discharge current because an equal voltage of opposite polarity on capacitor 13 opposes the voltage on the capacitor 14.

Second preferred embodiment of exciter circuit 10'

A second preferred embodiment of the exciter circuit of the present invention is denoted as 10' in FIG. 7. In this embodiment, the trigger circuit 60 shown in the first embodiment is not needed since it is assumed that the ignition system 500' includes a bulk or pellet semiconductor igniter plug 502' having a lower spark inception voltage on the order of 2000 V. FIG. 7 shows a schematic representation of the exciter circuit 10'.

Semiconductor igniter plugs are fashioned from surface gap igniters, i.e. igniters where the electrodes are coaxial such that the spark discharge travels over the surface of the intervening insulator. Two types of semiconductor igniter plugs are common. In the first type of semiconductor igniter plug, a toroidal pellet of bulk semiconductor material replaces the insulator between the electrodes at the igniter tip, hence the name bulk or pellet semiconductor igniter plug. In the second type of semiconductor igniter plug, the insulator surface between the electrodes is coated with a thin film of semiconductor paint, hence the name thin film semiconductor igniter plug.

In both types of semiconductor igniter plugs, the semiconductor material serves to reduce the spark inception voltage from 15000 V to 5000 V or less. The mechanism is different in each case and requires that output voltage from the exciter circuit to be tailored to the specific type of igniter plug. Where the semiconductor is a bulk material, it acts much like a Zener or transient suppressor. The bulk material semiconductor igniter plug tends to limit voltage at the igniter tip to typically 1500 V. Since the exciter circuit open circuit output voltage (without the trigger circuit) is typically 2000 to 3000 V, no trigger circuit is needed to boost the exciter circuit output voltage.

The spark inception interval, during which voltage across the igniter tip is high, lasts for several microseconds. The bulk material semiconductor igniter plug current during spark inception is between 10 and 100 amps. The igniter plug current heats the bulk semiconductor material, which boils electrons off its surface of the semiconductor material into the space between igniter plug electrodes. In effect, this boiling off of electrons reduces the spark inception voltage compared to that of a conventional surface gap igniter.

In a semiconductor igniter plug where the semiconductor material is a thin film coating on the ceramic surface between electrodes, an exciter output voltage of 2000 to 3000 V will heat the semiconductor and provide spark inception. This happens in much the same way as it does with the bulk semiconductor material. But such heating severely erodes the thin film causing the igniter to fail prematurely after approximately 100,000 sparks. However, when a 5000 V pulse is applied to a thin film semiconductor igniter plug, spark inception takes place in a fraction of a microsecond. The semiconductor igniter plug current is less than 10 amperes, thus, little or no heating of the semiconductor film material takes place.

A non-heating mechanism for spark inception takes place at 5000 volts. One explanation is that the semiconductor material distorts the electric field between the electrodes so that localized field concentrations create small surface sparks that jump from island to island on the film surface, which effectively shortens the gap between electrodes.

In the second preferred embodiment, the trigger circuit 60 is eliminated and the output terminal 50 of the pulse forming network 30 is connected directly to the high voltage terminal 504' of the bulk semiconductor igniter plug 504'.

While the preferred embodiments of the present invention have been described with a degree of particularity it is the intent that the invention include modifications from the disclosed design falling within the spirit or scope of the appended claims.

What is claimed is:

1. A method for energizing an igniter plug for initiating combustion of a combustible material comprising the steps of:

a) providing an energy source having a signal output;

b) coupling the signal output from the energy source to first and second capacitors to charge the capacitors during a charging cycle, the first and second capacitors being charged to respective predetermined voltage magnitudes;

c) coupling a voltage on one side of the first capacitor to an igniter plug electrode, said igniter plug providing a spark if the voltage at the igniter electrode exceeds an igniter plug threshold; and d) sensing the voltage on one of the first and second capacitors and in response to a sensing of a sufficient voltage on said one of the first and second capacitors, reversing a polarity of the voltage on said second capacitor to increase the voltage coupled to the igniter electrode to a level above the igniter threshold, the voltage level being greater than the predetermined respective voltage magnitudes of the first and second capacitors.

2. The method of claim 1 wherein the step of reversing the polarity of the voltage on the second capacitor includes the substep of providing a polarity reversal circuit including a solid state switch and a resonant coil coupled to the second capacitor and the substep of switching the solid state switch to a conductive state to energize the resonant coil and transferring charge from the second capacitor to the resonant coil to reverse the polarity of the voltage on the second capacitor.

3. An exciter circuit for an ignition system including an igniter plug placed within a region containing a combustible material, the exciter circuit comprising:

a) an energy storage device including a plurality of energy storage elements;

b) a charging circuit for charging the plurality of energy storage elements to respective predetermined voltage magnitudes;

c) a discharge circuit electrically coupled to the energy storage device and the igniter plug and providing a conductive discharge path between the energy storage device and the igniter plug for periodically energizing the igniter plug by applying an output signal to the igniter plug, the discharge circuit output signal having a voltage magnitude sufficient to initiate a spark across electrodes of the igniter plug;

d) the discharge circuit including a polarity reversal circuit coupled to the energy storage device for periodically reversing a polarity of a charge stored by one energy storage element of the plurality of energy storage elements and after reversal of polarity of the charge stored by the one storage element subsequently discharging the energy storage device to generate an energy storage device output signal having a voltage magnitude that is greater than the predetermined voltage magnitudes of the plurality of energy storage elements; and e) the discharge circuit including a pulse forming circuit for converting the energy storage device output signal into the discharge circuit output signal applied to the igniter plug.

4. The exciter circuit of claim 3 wherein the discharge circuit further includes a trigger circuit including an autotransformer and a resonant capacitor to increase a voltage magnitude of an output signal of the pulse forming circuit to generate the discharge circuit output signal applied to the igniter plug.

5. The exciter circuit of claim 3 wherein the pulse forming circuit includes a saturable reactor and a resonant capacitor to increase a voltage magnitude of the energy storage device output signal.

6. The exciter circuit of claim 3 wherein the charging circuit includes an AC power source and an AC to DC converter for generating a regulated DC charging current for charging the energy storage device.

7. The igniter circuit of claim 3 wherein the plurality of energy storage devices comprise first and second capacitors electrically coupled in series and the polarity reversal circuit is electrically coupled between the first and second capacitors.

8. The exciter circuit of claim 3 wherein the polarity reversal circuit includes a solid state switch and a resonant coil coupled between the energy storage device and the solid state switch, the solid state switch switching to its conductive state to initiate reversal of the polarity of the energy storage element by a transfer of stored energy of the energy storage element between the energy storage element and the resonant coil, the solid state switch and the resonant coil not being on the conductive discharge path.

9. The exciter circuit of claim 8 wherein the solid state switch is a thyristor.

10. The exciter circuit of claim 3 further including a detector and gate circuit electrically coupled to the polarity reversal circuit and the one energy storage element to monitor the voltage magnitude of the charge stored by the one energy storage element and to initiate polarity reversal of the charge stored by the one energy storage element when the voltage magnitude of the charge stored by the one energy storage element exceeds its predetermined voltage magnitude.

11. The exciter circuit of claim 10 further including a spark rate regulator circuit electrically coupled to the detector and gate circuit for controlling a frequency at which the energy storage device output signal is generated by the discharge circuit.

12. An exciter circuit for an ignition system including an igniter plug placed within a region containing a combustible material, the exciter circuit comprising:

a) an energy storage device including a plurality of energy storage elements;

b) a charging circuit for charging the plurality of energy storage elements to respective predetermined voltage magnitudes;

c) a discharge circuit electrically coupled to the energy storage device and the igniter plug and providing a conductive discharge path between the energy storage device and the igniter plug for periodically energizing the igniter plug by applying an output signal to the igniter plug, the discharge circuit output signal having a voltage magnitude sufficient to initiate a spark across electrodes of the igniter plug;

d) the discharge circuit including a polarity reversal circuit coupled to the energy storage device for periodically reversing a polarity of a charge stored by one energy storage element of the plurality of energy storage elements and discharging the energy storage device to generate an energy storage device output signal having a voltage magnitude that is greater than the predetermined voltage magnitudes of the plurality of energy storage elements; and e) the discharge circuit including a pulse forming circuit for converting the energy storage device output signal into the discharge circuit output signal applied to the igniter plug;

f) wherein the polarity reversal circuit includes a solid state switch and a resonant coil coupled between the energy storage device and the solid state switch, the solid state switch switching to its conductive state to initiate reversal of the polarity of the energy storage element by a transfer of stored energy of the energy storage element between the energy storage element and the resonant coil, the solid state switch and the resonant coil not being on the conductive discharge path.

13. The exciter circuit of claim 12 wherein the discharge circuit further includes a trigger circuit including an autotransformer and a resonant capacitor to increase a voltage magnitude of an output signal of the pulse forming circuit to generate the discharge circuit output signal applied to the igniter plug.

14. The exciter circuit of claim 12 wherein the pulse forming circuit includes a saturable reactor and a resonant capacitor to increase a voltage magnitude of the energy storage device output signal.

15. The exciter circuit of claim 12 wherein the charging circuit includes an AC power source and an AC to DC converter for generating a regulated DC charging current for charging the energy storage device.

16. The exciter circuit of claim 12 wherein the solid state switch is a thyristor.

17. The exciter circuit of claim 12 wherein the plurality of energy storage devices comprise first and second capacitors electrically coupled in series and the polarity reversal circuit is electrically coupled between the first and second capacitors.

18. The exciter circuit of claim 12 further including a detector and gate circuit electrically coupled to the polarity reversal circuit and the one energy storage element to monitor the voltage magnitude of the charge stored by the one energy storage element and to initiate polarity reversal of the charge stored by the one energy storage element when the voltage magnitude of the charge stored by the one energy storage element exceeds its predetermined voltage magnitude.

19. The exciter circuit of claim 18 further including a spark rate regulator circuit electrically coupled to the detector and gate circuit for controlling a frequency at which the energy storage device output signal is generated by the discharge circuit.

20. An ignition system comprising:

a) an igniter plug for placement within a region containing a combustible material for providing a spark to ignite said material, said igniter plug including an input electrode for receipt of an output signal for initiating said spark;

b) an exciter circuit for periodically generating the output signal to initiate the igniter plug spark, the exciter circuit including:

1) an energy source for providing electric energy at a source output;

2) a discharge circuit including an energy storage device electrically coupled to the energy source output for storing electrical energy from the energy source in a plurality of energy storage elements, each of the plurality of energy storage devices being charged to a respective predetermined voltage magnitude; and 3) the discharge circuit further including a polarity reversal circuit coupled to the energy storage device for periodically reversing a polarity of a charge stored by one of the plurality of energy storage elements, the discharge circuit after reversal of polarity of the charge stored by the one of the plurality of storage elements subsequently discharging the plurality of energy storage elements and generating the output signal wherein a voltage magnitude of the output signal is substantially equal to a sum of the respective predetermined voltage magnitudes of the plurality of energy storage elements.

21. The ignition system of claim 20 wherein the polarity reversal circuit includes a solid state switch and a resonant coil coupled between the energy storage device and the solid state switch, the solid state switch switching to its conductive state to initiate reversal of the polarity of the energy storage element by a transfer of stored energy of the energy storage element between the energy storage element and the resonant coil, the solid state switch and the resonant coil not being on the conductive discharge path.

22. The ignition system of claim 20 wherein the discharge circuit further includes a trigger circuit including an autotransformer and a resonant capacitor to increase a voltage magnitude of the energy storage device output signal.

23. The ignition system of claim 20 wherein the charging circuit includes an AC power source and an AC to DC converter for generating a regulated DC charging current for charging the energy storage device.

24. The ignition system of claim 20 further including a detector and gate circuit electrically coupled to the polarity reversal circuit and the one energy storage element to monitor the voltage magnitude of the charge stored by the one energy storage element and to initiate polarity reversal of the charge stored by the one energy storage element when the voltage magnitude of the charge stored by the one energy storage element exceeds its predetermined voltage magnitude.

25. The ignition system of claim 24 further including a spark rate regulator circuit electrically coupled to the detector and gate circuit for controlling a frequency at which the energy storage device output signal is generated by the discharge circuit.

26. The ignition system of claim 20 wherein the discharge circuit further includes a pulse forming circuit for converting an energy storage device output signal generated upon discharging the plurality of energy storage elements to the output signal applied to the igniter plug input electrode.

27. The ignition system of claim 26 wherein the pulse forming circuit includes a saturable reactor and a resonant capacitor to increase a voltage magnitude of the energy storage device output signal.

28. The ignition system of claim 26 wherein the solid state switch is a thyristor and the plurality of energy storage devices comprise first and second capacitors electrically coupled in series and the polarity reversal circuit is electrically coupled between the first and second capacitors.

* * * * *